US008218813B2

(12) United States Patent
Bell

(10) Patent No.: US 8,218,813 B2
(45) Date of Patent: Jul. 10, 2012

(54) METHOD FOR DOUBLE FEED DETECTION

(75) Inventor: Alan Bell, Waterlooville (GB)

(73) Assignee: Wessex Technology Opto-Electronic Products Ltd., Waterlooville, Hampshire (GB)

( * ) Notice: Subject to any disclaimer, the term of this patent is extended or adjusted under 35 U.S.C. 154(b) by 897 days.

(21) Appl. No.: 11/573,618

(22) PCT Filed: Aug. 12, 2005

(86) PCT No.: PCT/GB2005/003190

§ 371 (c)(1),
(2), (4) Date: Oct. 23, 2008

(87) PCT Pub. No.: WO2006/016186

PCT Pub. Date: Feb. 16, 2006

(65) Prior Publication Data

US 2009/0051108 A1 Feb. 26, 2009

(30) Foreign Application Priority Data

Aug. 12, 2004 (GB) ..... 0418040.2

(51) Int. Cl.
*G06K 9/00* (2006.01)

(52) U.S. Cl. ..... 382/101; 382/100; 382/103

(58) Field of Classification Search ..... 382/100, 382/101, 102, 224; 209/583, 900, 552; 271/258.01, 271/259, 265.01; 235/375–382, 382.5
See application file for complete search history.

(56) References Cited

U.S. PATENT DOCUMENTS

| | | | | |
|---|---|---|---|---|
| 4,733,226 | A * | 3/1988 | Kasuya et al. | 340/674 |
| 5,331,151 | A | 7/1994 | Cochran et al. | 250/223 |
| 6,817,610 | B2 * | 11/2004 | Rompe | 271/265.04 |
| 7,835,540 | B2 * | 11/2010 | Philippe et al. | 382/101 |
| 7,883,088 | B2 * | 2/2011 | Nutzel et al. | 271/258.01 |
| 2003/0132572 | A1 * | 7/2003 | Rompe | 271/258.01 |

FOREIGN PATENT DOCUMENTS

| | | |
|---|---|---|
| FR | 2546083 | 5/1983 |
| WO | WO 03042082 | 5/2003 |
| WO | WO 03047773 A2 | 6/2003 |

OTHER PUBLICATIONS

Office Action for corresponding Japanese Application No. 2007-525363, dated Apr. 11, 2011.
English translation of Office Action for corresponding Japanese Application No. 2007-525363.
Japanese Patent Application Publication No. 2005-512030, published Apr. 28, 2005.

* cited by examiner

*Primary Examiner* — Vikkram Bali
*Assistant Examiner* — Nancy Bitar
(74) *Attorney, Agent, or Firm* — Koppel, Patrick, Heybl & Philpott

(57) ABSTRACT

This invention relates to a method of detecting double-feed of email items (10,12) that allows difficult mail types to be processed correctly, wherein simultaneous views are taking of both the sides and bottom of mail items and these views are processed to determine whether or not double feed has occurred. This can be achieved using either two cameras or a single camera (16,2) with additional optics.

8 Claims, 5 Drawing Sheets

METHOD FOR DOUBLE FEED DETECTION

The present invention relates to automated sorting machines and more particularly to apparatus for detecting double feeds.

When mail is sorted in automated sorting machines it is transported by a series of belts and pulleys. Before being fed through the sorting machine the mail is arranged in a stack on an input hopper. A de-stacker, or singulator which may comprise belts, rollers and vacuum or suction components is used to singulate the mail, that is pull it of the stack, one item at a time and feed it into the belt system.

A common problem with singulator mechanisms is that they are known to occasionally pull two or more items into the belt systems. This is known as a 'double feed', even though often it can be three or more items travelling together through the belt path. Double-feeds can cause a range of problems for mail administrations, these can include an increased incidence of sorting machine jams, and a reduced quality of service as mail items are sent to the wrong destination. On a typical sorting machine double-feed rates of 0.4% to 1.5% of the mail flow can be anticipated.

There are various causes of double-feeds, these can include poor set-up of the singulator, mail being trapped together, bulk mail, which consists of factory produced mail items of essentially similar characteristics which can be glued together if the production machinery is not set up properly.

The normal method of double-feed detection is to use a line-scan camera connected to a computer below the belt path, which looks up at the base of the passing mail items. The captured image is analysed by computer software, which looks for indications that a double feed has occurred. If a double-feed is detected then a message is sent to the sorter by the computer and the double feed is separated from the rest of the mail so that it can be separated before being re-fed through the machine. Examples of such systems are the disclosures of WO 03/042082, U.S. Pat. No. 5,331,151 and FR 2,546,083.

The above process works reasonably well with ordinary envelopes, however special types of envelope can cause problems for double feed detectors which result many mail items being incorrectly identified as double-feeds. This incorrect operation is known as a 'false-double', and in the case of bulk mail, it can result in many thousands of items being sent to the double-feed output.

The particular invention relates to a different method of reducing the problem of false-doubles.

The present invention provides a method for detecting doubles, when singulating batches of flat mail pieces as the pieces are conveyed on their narrow sides in a longitudinal direct along a path, comprising locating below the transport path an electronic line-scan camera with its optical longitudinal axis transverse to the transport direction of the mail pieces whereby a scan of the bottom edges of the mail pieces through an aperture in the base place is obtained, and comparing the characteristics of the line by line scanned mail piece bottom edge image with those of predetermined sets of characteristics derived from typical samples of bottom edge images in order to determine whether or not a double feed has occurred, characterised in that means are provided for simultaneously viewing the side of a piece of mail adjacent the bottom edge simultaneously with the bottom edges.

In order that the present invention be more readily understood, embodiments thereof will now be described by way of example with reference to the accompanying drawings, in which:—

Figure 1:
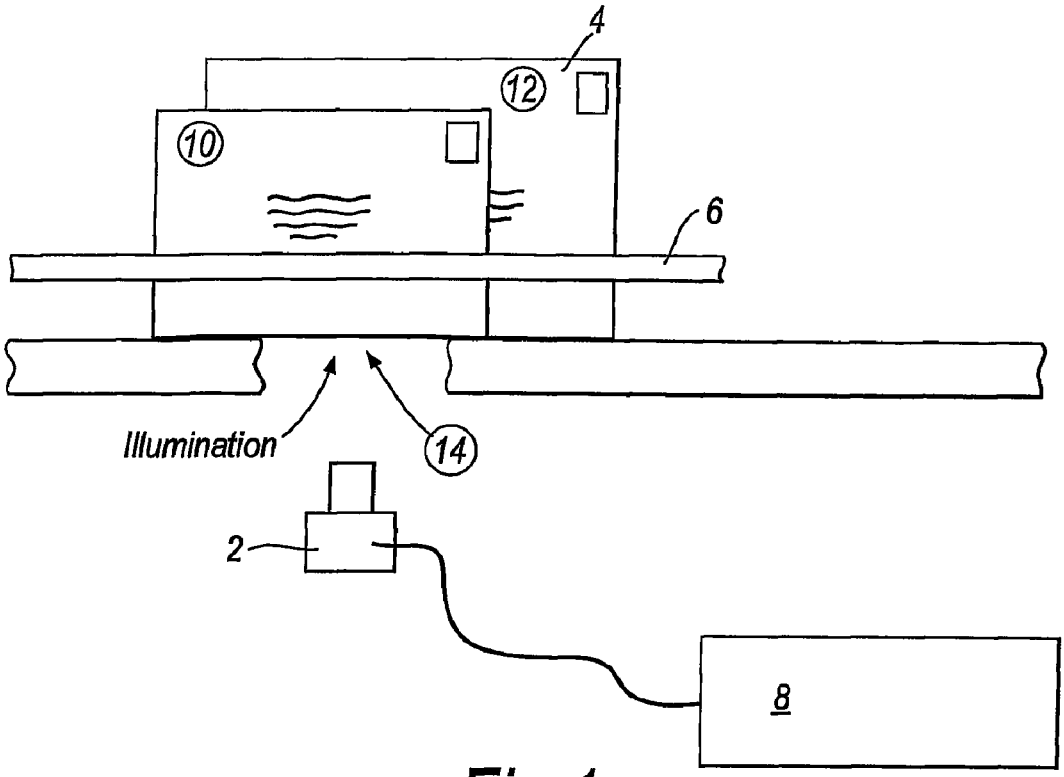
Fig.1 PRIOR ART
FIG. 1 shows a diagrammatic representation of conventional double feed detection apparatus.

Double-feed detectors are in common use in mail systems, and can often fail to operate because of 'difficult' mail types. This invention describes a series of improvements to double feed detectors that allow difficult mail types to be processed correctly. The preferred improvement is one where simultaneous views are taken of both the side and bottom of mail items and these views are processed to determine whether or not double feed has occurred. This can be achieved using either two cameras or a single camera with additional optics.

The same reference numerals are used throughout the drawings to refer to the same parts, namely:—

2 Line Scan Camera
4 Double Feed Mail Item
6 Belt Path
8 Computer
10 (image of) Small Letter
12 (image of) Large Letter
14 Hole in Bed-plate
16 Sideways on Camera
18 Side View Mirror
20 Side View Prism
22 Selfec Lens Array FIG. 1 shows a typical arrangement for a double feed detector, the line scan camera (2) looking up at the base of the double-feed mail item (4). This is done through a hole in the bed-pate (14). The double-feed, in this case comprising a short (10) and a long (12) letter as it moves through the mail path (6). The computer (8) receives an image represent in FIG. 2.

Figure 2:
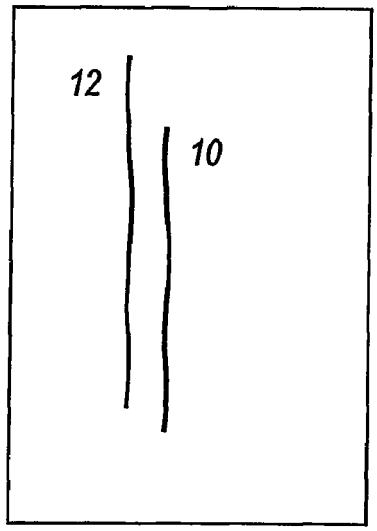
FIG. 2 shows a pictorial representation of the output of the apparatus shown in FIG. 1.

FIG. 2 shows a representation of the image containing two linear features representative of both of the mail items.

Figure 3:
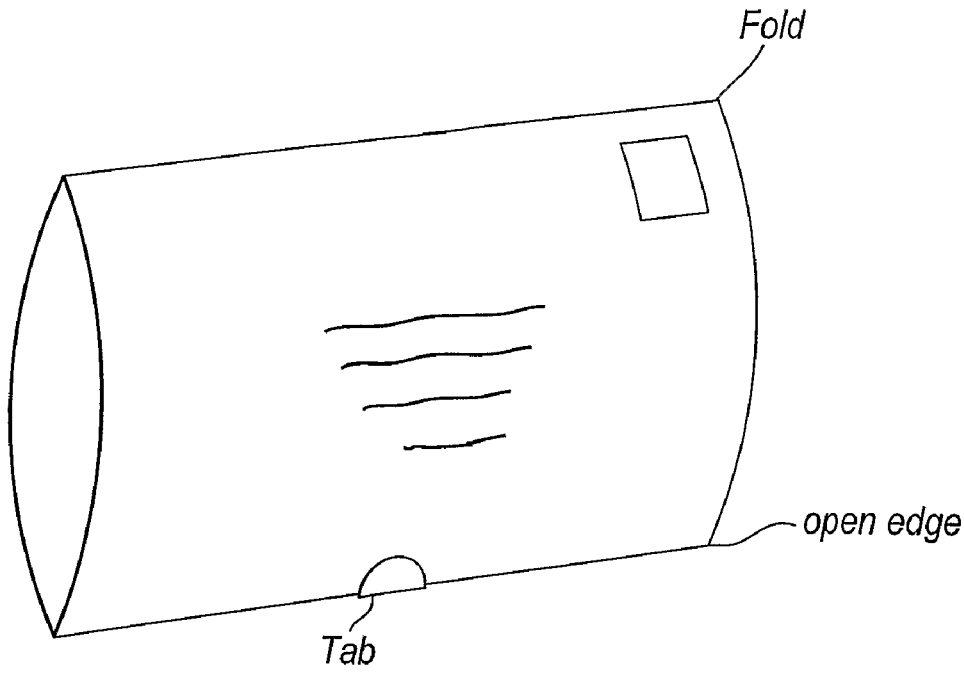
FIGS. 3 and 4 show representation of pieces of mail which may cause problems for the apparatus shown in FIG. 1.
Figure 4:
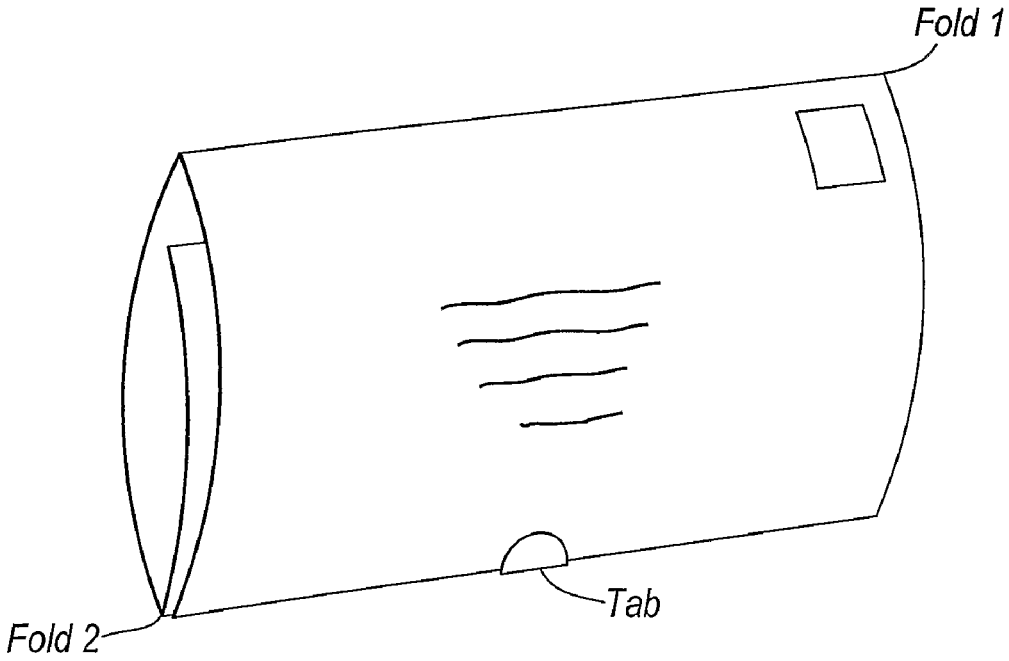

Particular problems can occur when special types of mail are encountered. Some of these are shown in FIGS. 3 and 4. A Bi-fold item is a single piece of paper with a single fold, held together on the open edge with a staple or a tab constructed from paper or from clear tape. A tri-fold item is a single piece of paper folded in two places held together at the bottom in a similar manner. The problem that these items cause is understood when these items are viewed from underneath. The two linear features that are seen by the camera can be misinterpreted as double-feeds.

Figure 5:
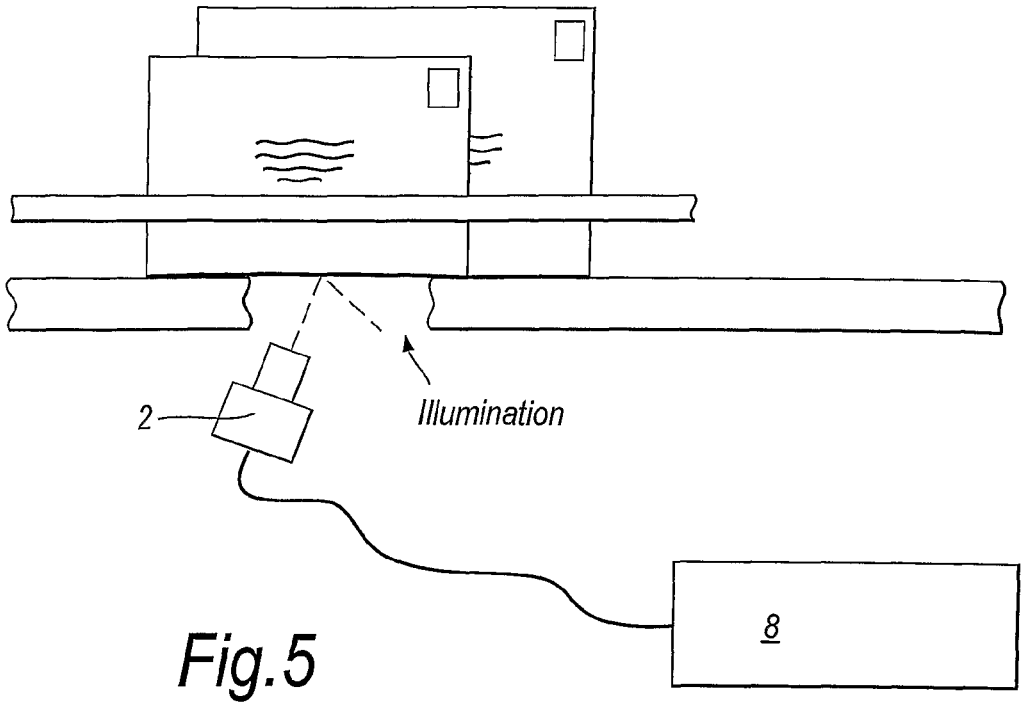
FIG. 5 shows a diagrammatic representation of part of apparatus according to the present invention.

FIG. 5 shows the same basic arrangement as FIG. 1, except that the camera (2) is angled toward (or away from) the flow of the mail. In this arrangement specula (direct) reflections from the clear tab render the otherwise invisible tab visible to the camera as the camera sees the reflected light from the surface of the tab.

The current invention discloses several different methods of reducing this problem.

Method 1 Side View of the Base of the Mail Using a Sidewise on Camera

Figure 6:
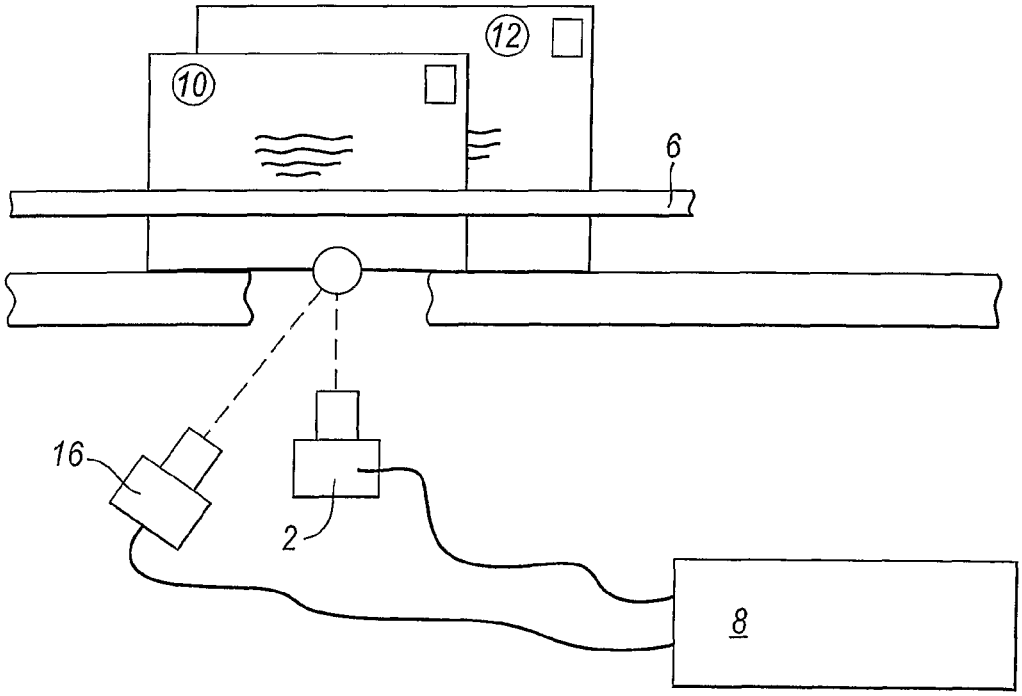
FIG. 6 shows a diagrammatic representation of an embodiment of the present invention.

FIG. 6 shows an additional camera (16) looking at the side of the mail in high resolution and is in addition to the Camera 2 of FIG. 5 or the Camera of FIG. 1. This camera is then able to see the outline of the tab as it extends beyond the normal bottom straight edge of the mail. The drawback of this method is that it requires an additional camera and frame grabber, which adds to the cost and complexity. This solution may cause secondary problems, as the two images from beneath and the side need to be aligned mechanically and optically.

Method 2 Side View of the Base of the Mail Using Reflection

Figure 7:
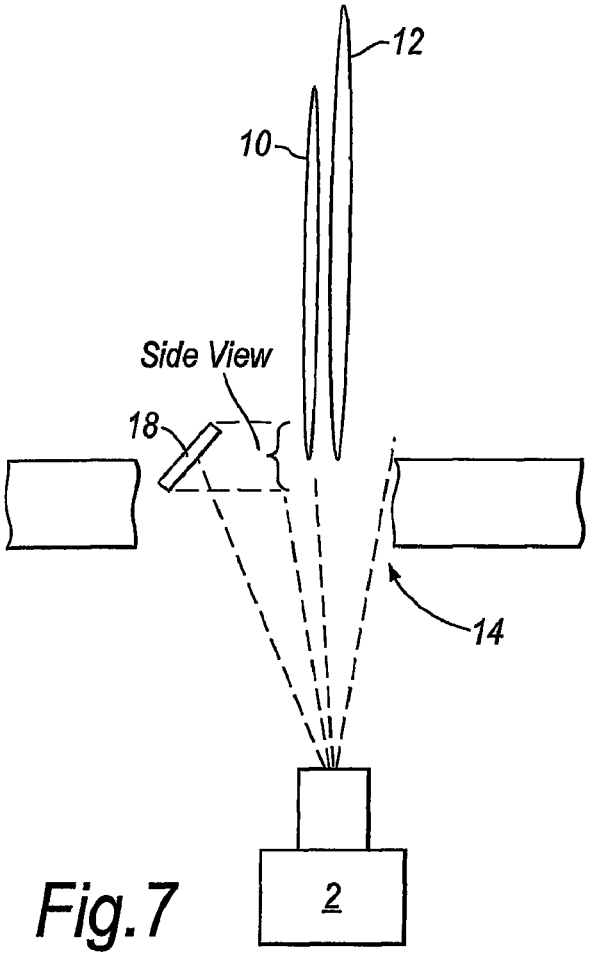
FIG. 7 shows a diagrammatic representation of another embodiment of the present invention.

FIG. 7 shows a mirror added to the optical system angled at 45 degrees to the mail piece. This allows the camera 2 to see the side of the item at the same time as the base of the item. This is simpler than adding an additional camera, and has the added advantage of ensuring complete alignment of the underneath view and the side view. The illumination is arranged to allow direct reflection from clear tabs.

Figure 8:
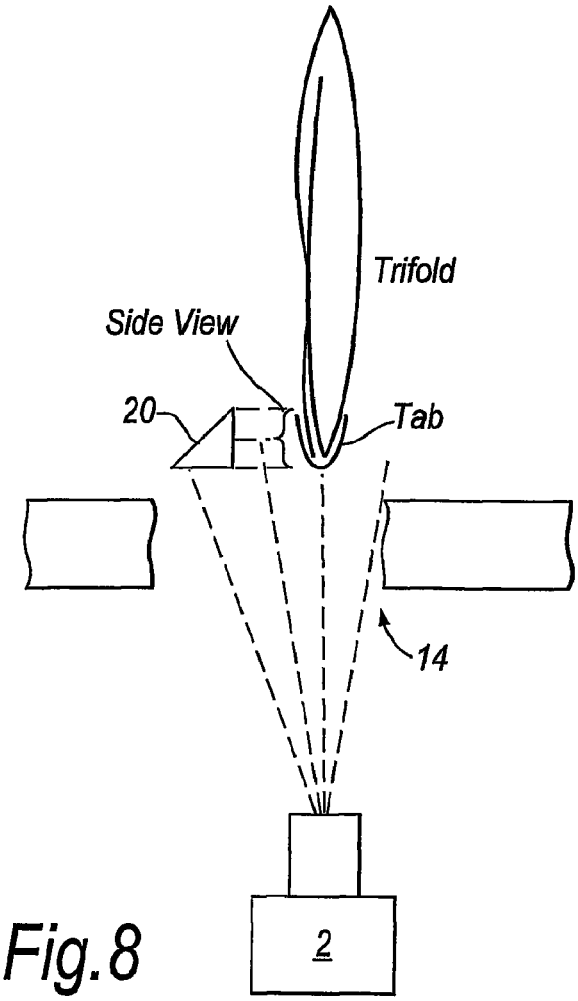
FIGS. 8 and 9 show further embodiments of the present invention.

FIG. 8 shows that the same affect can be achieved using a mirrored prism (20) in place of the mirror; this has further advantages. The exposed optical surface is easier to clean, and the passage of the light passing through the body of the glass has longer focal distance than the mirror alone.

Figure 9:
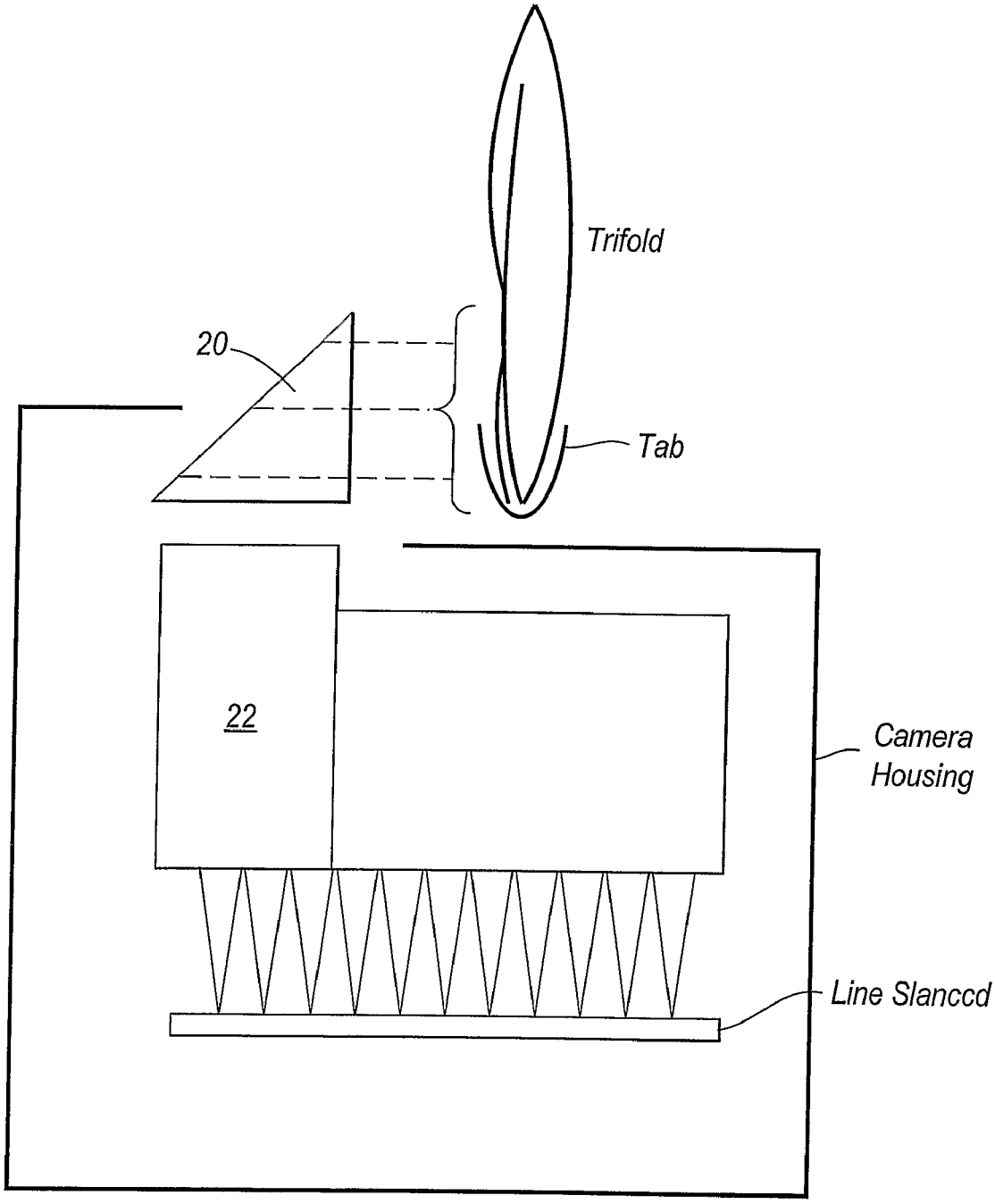

FIG. 9 shows a further improvement can be made in Selfoc Lens Array (SLA) (made by Nippon Sheet Glass, of Japan) lenses are used in the line scan camera. One segment of lens can be chosen to be optimal for the detection of the base of the mail item, the other can be chosen to give a good image of the side of the base of the mail. The parameters that determine the choice of lens include the aperture, and the focal length.

In the above methods, the additional camera 16 or optics for viewing the sides of the pieces of mail is disposed normal to the plane of the pieces of mail. It is possible to modify this so that the camera or optics are angled, for example, with respect to the direction of travel of the pieces of mail for the same reasons as the angle of the main camera 2.

Method 3 Learning Mode

In addition to the arrangements described above, we may include a further method of resolving this problem which is to configure the image analysis software to remember the characteristics of the doubles that are detected, and if a significant number of doubles occur with sufficiently similar characteristics either consecutively or in a short period of time, allow them to be recognised as single item. This can be as a result of the bottom or side views or both.

The invention claimed is:

1. A method for detecting if a double feed has occurred or not in a double feed detection system when mail pieces with tabs are conveyed on their edge in a longitudinal direction along a path, comprising the steps of:

obtaining a scan of a bottom edge of the mail pieces by locating an electronic line-scan camera below the transport path such that an optical longitudinal axis of the camera is transverse to the transport direction of the mail pieces, whereby said scan is obtained through an aperture in a base plate;

comparing the characteristics of the line by line scanned mail piece bottom edge image with those of predetermined sets of characteristics derived from typical samples of bottom edge images in order to determine whether or not a double feed has occurred, characterized by;

simultaneously viewing a side of a piece of mail adjacent the bottom edge simultaneously with the bottom edges with a simultaneous viewing means; and processing images produced by the camera and the simultaneous viewing means to identify if the mail piece is a single mail piece with a tab, or if a double feed has occurred.

2. The method of claim 1 wherein the processing step includes aligning the views obtained of the bottom edges and sides of each mail piece to identify if a tab is present or not.

3. The method of claim 1 wherein said tab is made from clear material having a light reflective surface.

4. A method according to claim 1 comprising angling the axis of the camera with respect to the vertical so as to enable the tab on the piece of mail to be identified.

5. The method of claim 4 wherein the presence of the tab is detected when light from an illumination source in the double feed detection system is directly reflected from the tab, thereby rendering it visible to the camera wherein said tab is made from clear material having a light reflective surface.

6. The method according to claim 1 wherein the simultaneous viewing means is a further camera.

7. A method according to claim 1 wherein the simultaneous viewing means has a reflector for reflecting an image of the side of a piece of mail to the camera.

8. An apparatus including a computer configured to carry out the method according to claim 1, said computer comprising means for storing the characteristics of each mail piece scanned for a period of time, means for monitoring whether the stored characteristics are determined to represent a double feed, means for monitoring the frequency of such determination and for modifying the comparison means to classify subsequent similar images to be classified as single items.

* * * * *